US008102227B2

(12) United States Patent
Fujiwara et al.

(10) Patent No.: US 8,102,227 B2
(45) Date of Patent: Jan. 24, 2012

(54) ELECTROMAGNETIC RELAY

(75) Inventors: Tetsuya Fujiwara, Kyoto (JP); Yasusuke Takahashi, Kyoto (JP); Hiroshi Matsumoto, Kyoto (JP); Kazuchika Hiroki, Kyoto (JP); Masahiko Tashiro, Kyoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 276 days.

(21) Appl. No.: 12/278,637

(22) PCT Filed: Feb. 7, 2007

(86) PCT No.: PCT/JP2007/052122

§ 371 (c)(1), (2), (4) Date: Aug. 7, 2008

(87) PCT Pub. No.: WO2007/091595

PCT Pub. Date: Aug. 16, 2007

(65) Prior Publication Data

US 2009/0167469 A1 Jul. 2, 2009

(30) Foreign Application Priority Data

Feb. 8, 2006 (JP) ..... 2006-030751

(51) Int. Cl.
*H01H 51/22* (2006.01)

(52) U.S. Cl. ..... 335/78; 335/129

(58) Field of Classification Search ..... 335/78–86, 335/128–131

See application file for complete search history.

(56) References Cited

U.S. PATENT DOCUMENTS 4,310,818 A * 1/1982 Essler et al. ..... 335/135
4,761,627 A * 8/1988 Bell ..... 335/128
4,949,058 A * 8/1990 Nishikawa et al. ..... 335/128
5,144,270 A * 9/1992 Schedele et al. ..... 335/80
2004/0263293 A1* 12/2004 Saruwatari et al. ..... 335/128

FOREIGN PATENT DOCUMENTS

EP 1471557 A2 10/2004

(Continued)

OTHER PUBLICATIONS

Patent Abstracts of Japan, Publication No. 2004-327236, dated Nov. 18, 2004, 1 page.

(Continued)

*Primary Examiner* — Bernard Rojas
(74) *Attorney, Agent, or Firm* — Osha • Liang LLP

(57) ABSTRACT

The present invention provides an electromagnetic relay that can achieve desired operation characteristics by simple and inexpensive construction even if it has a small thickness. Therefore, a movable iron piece 20 is rotated by excitation or non-excitation of an electromagnet, a movable contact piece 43 is elastically deformed through a card 21, and a movable contact 46 opens and closes fixed contacts of fixed contact pieces. The movable iron piece 20 is provided with a card pressing portion 36 capable of pressing the card 21. The card 21 is provided with a contact piece pressing portion 37 capable of pressing the movable contact piece 43 by being rotated around a fulcrum. At least one of the movable iron piece and the card is provided with a press position changing portion, wherein when rotating the movable iron piece 20, force transmission from the movable iron piece 20 to the card 21 is performed at a position more distant from a press position by the card pressing portion 36 of the iron piece 20 with respect to the fulcrum, and then performed by the card pressing portion 36.

8 Claims, 12 Drawing Sheets

FOREIGN PATENT DOCUMENTS

| | | |
|---|---|---|
| JP | 61-178245 | 11/1986 |
| JP | 64-20614 | 2/1989 |
| JP | 2004-327236 | 11/1994 |

OTHER PUBLICATIONS

International Search Report issued in PCT/JP2007/052122 mailed on Mar. 6, 2007, with translation, 3 pages.

PCT International Preliminary Report on Patentability and PCT Written Opinion of the International Searching Authority issued in PCT/JP2007/052122 mailed on Aug. 21, 2008, 8 pages.

Extended European Search Report for Application No. 07708161.0/2214, mailed on Aug. 5, 2011, 5 pages.

* cited by examiner

【Fig. 1】
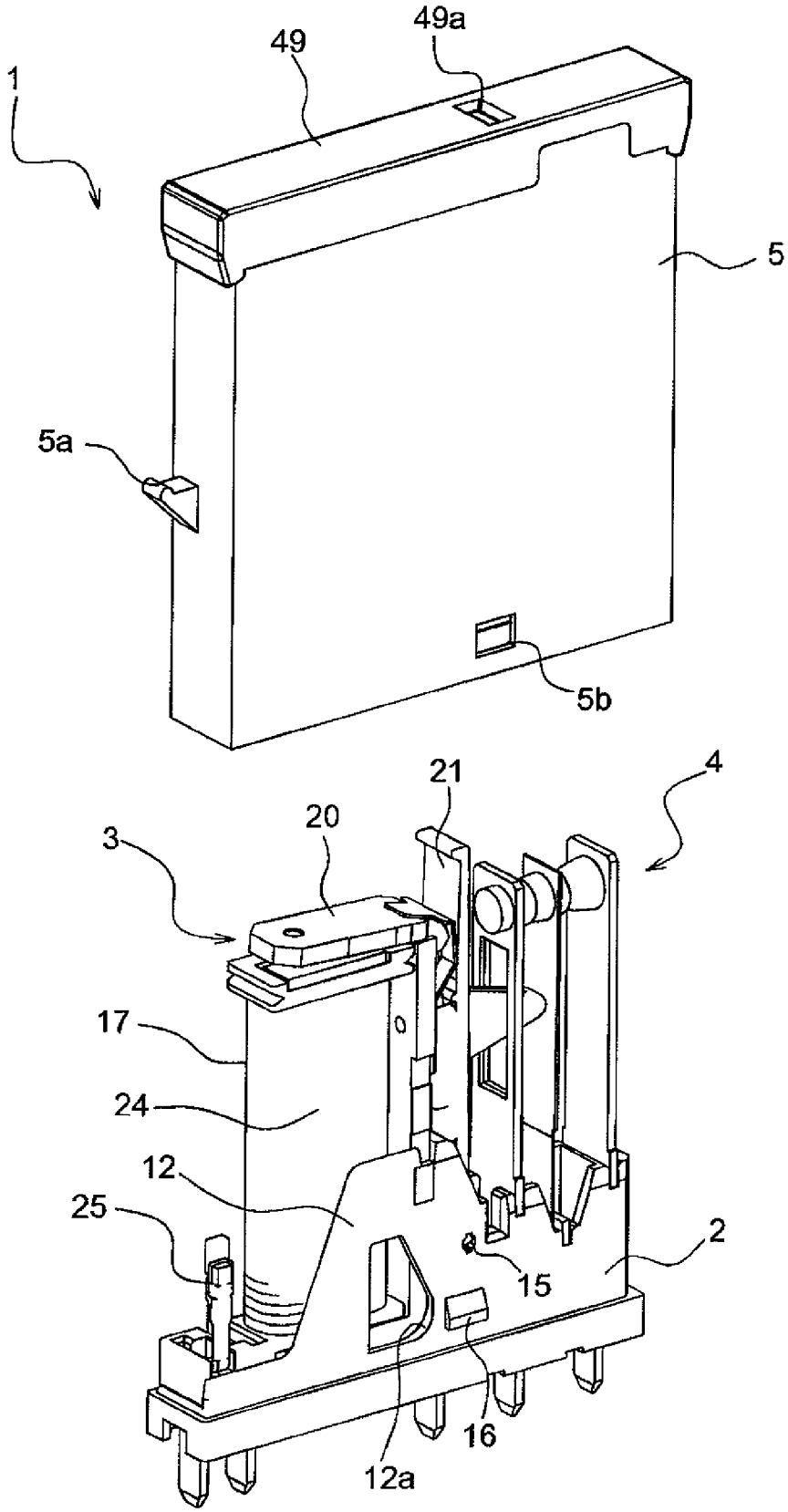

【Fig. 2】
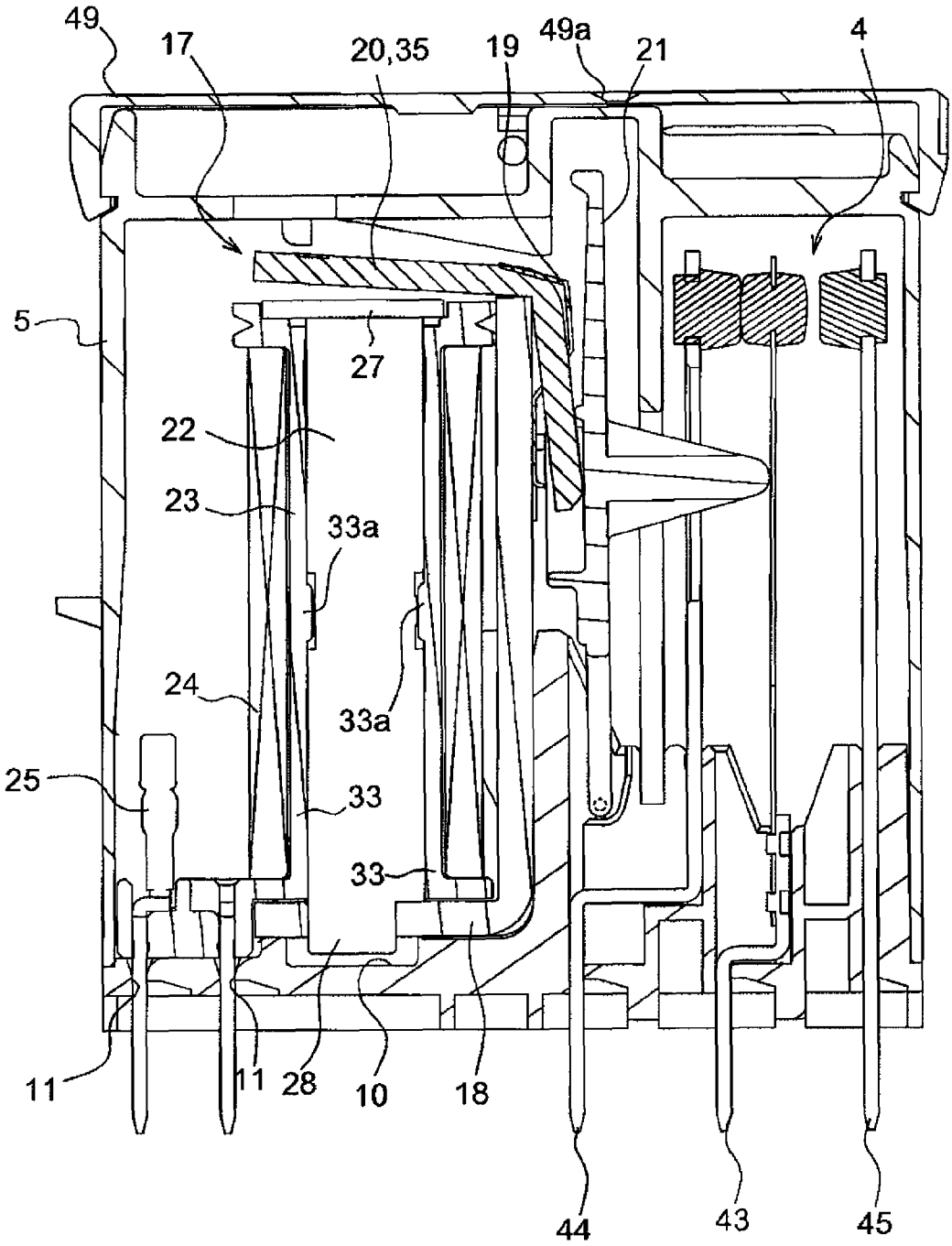

【Fig. 3】
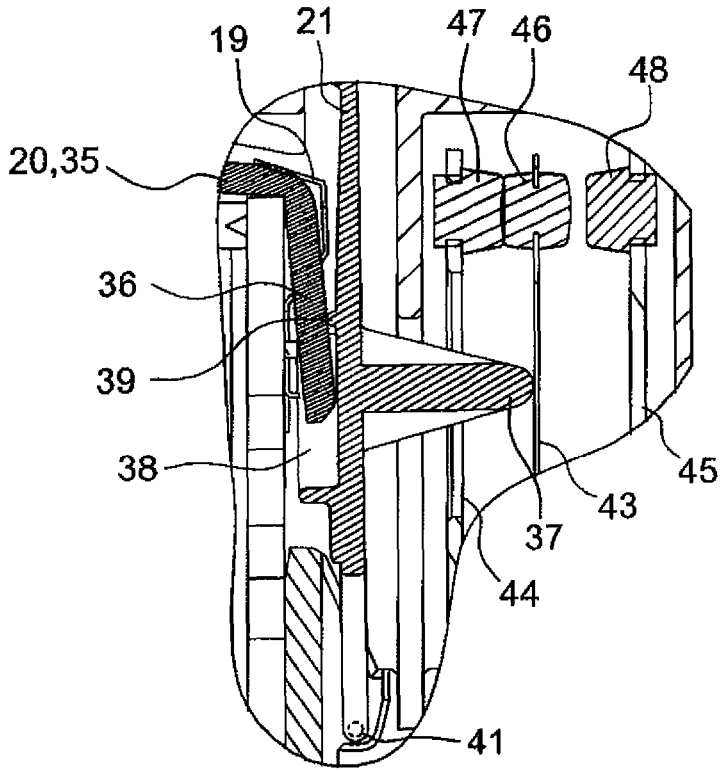
【Fig. 4】
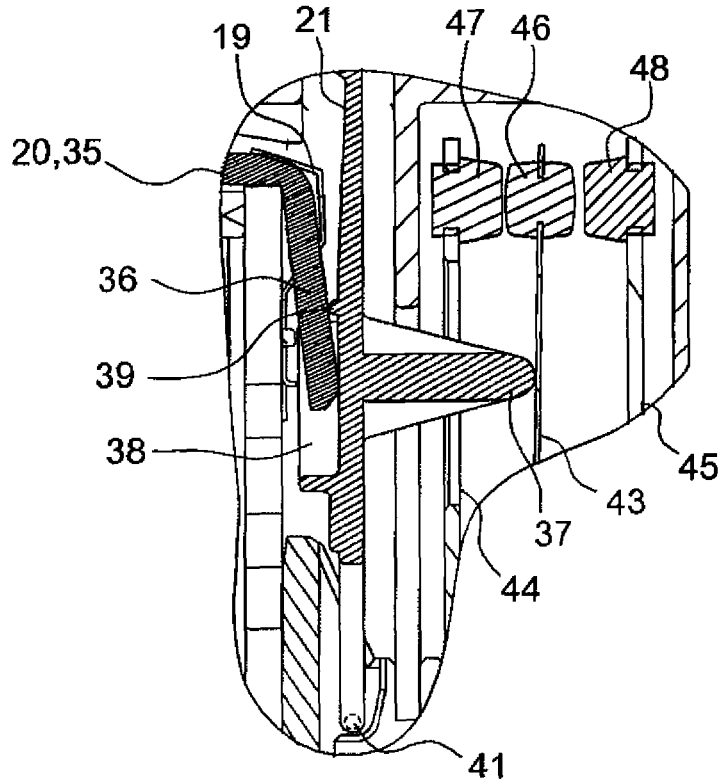

【Fig. 5】
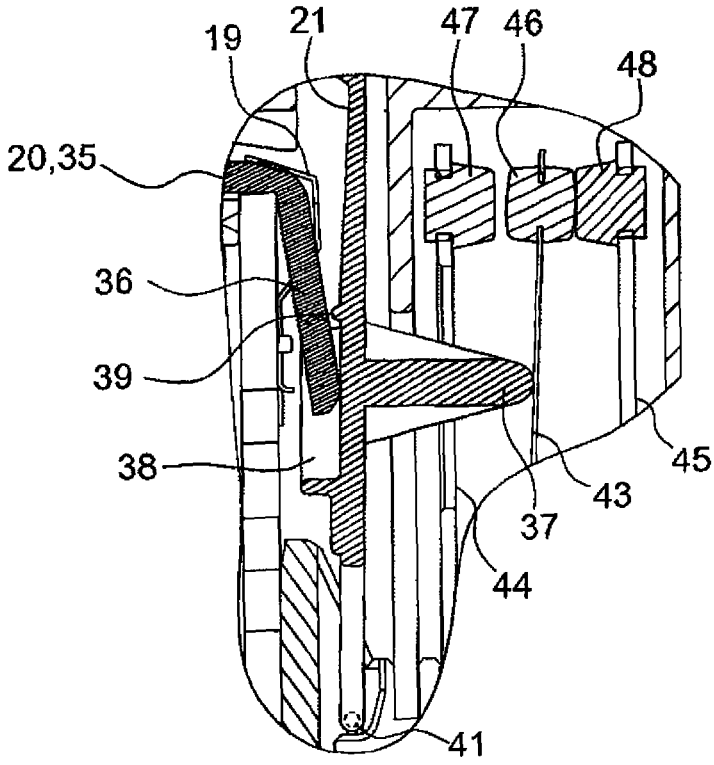
【Fig. 6】
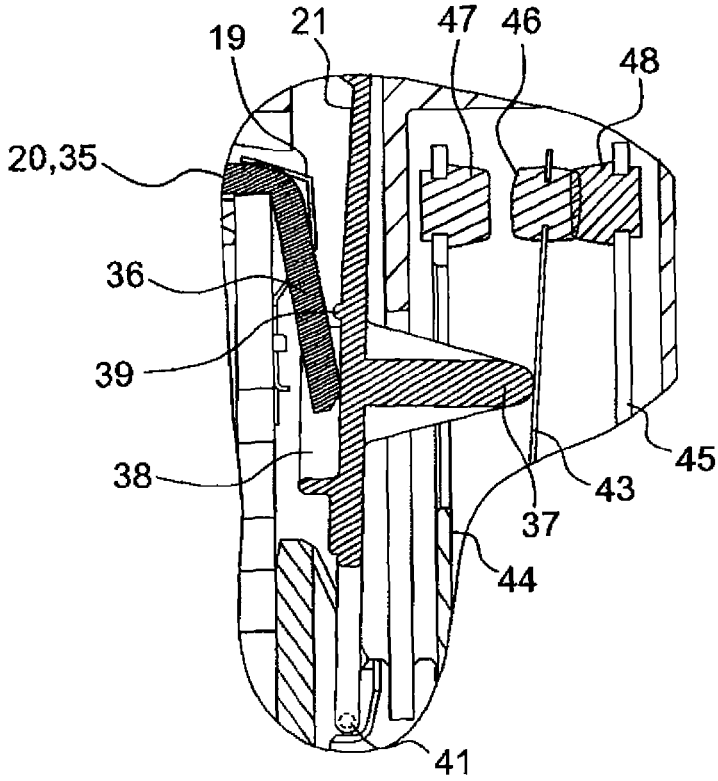

【Fig. 7】
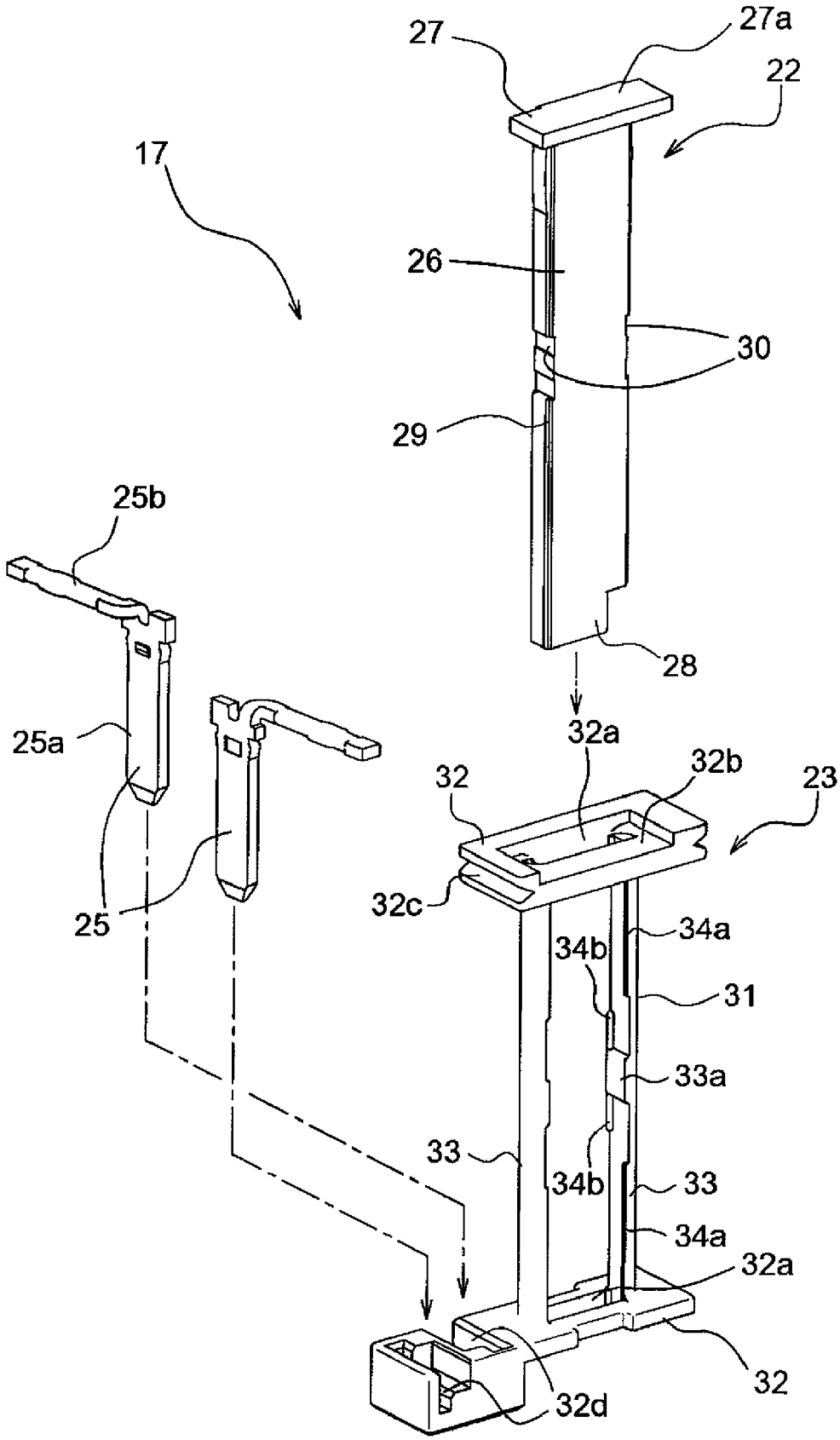

【Fig. 8】
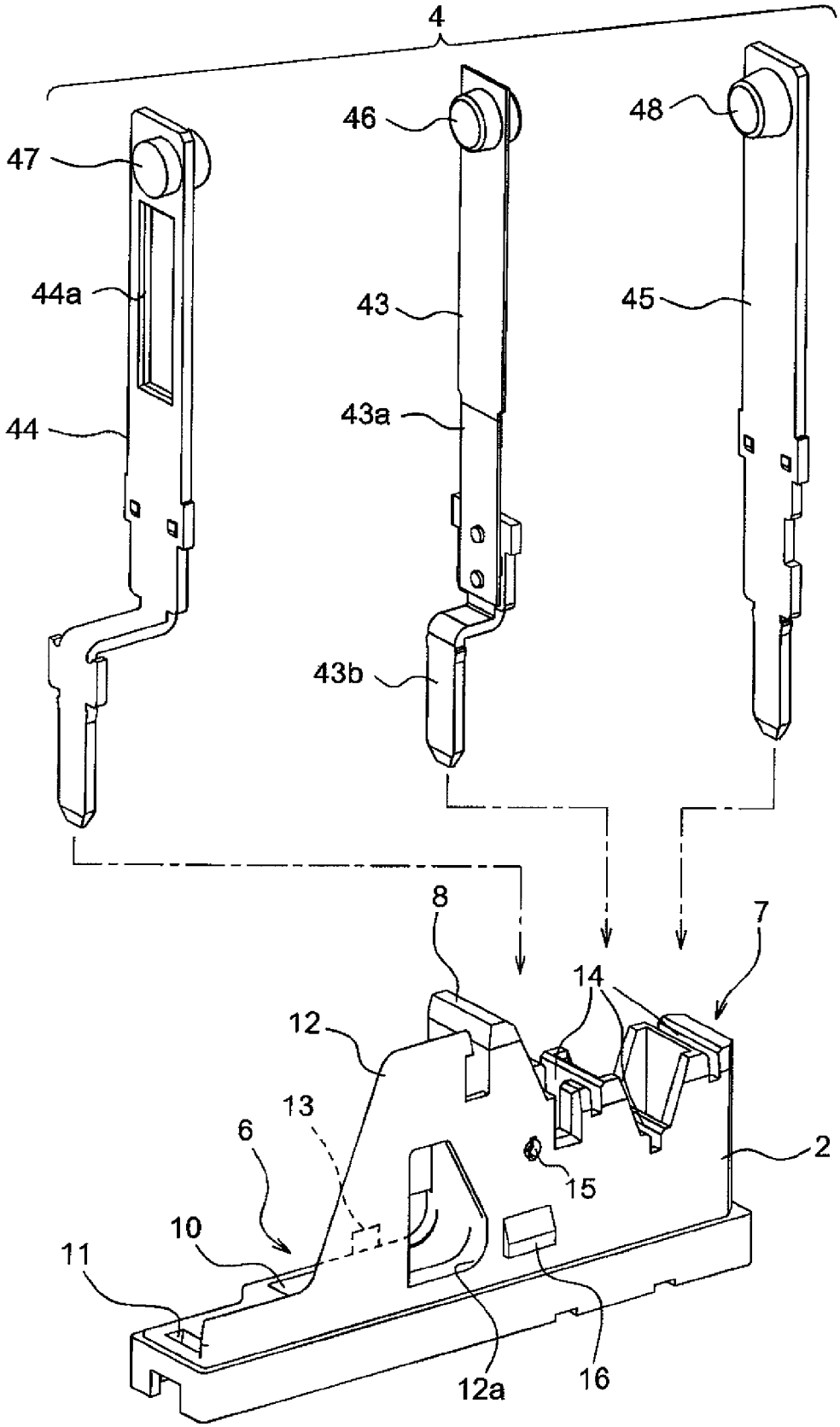

【Fig. 9】
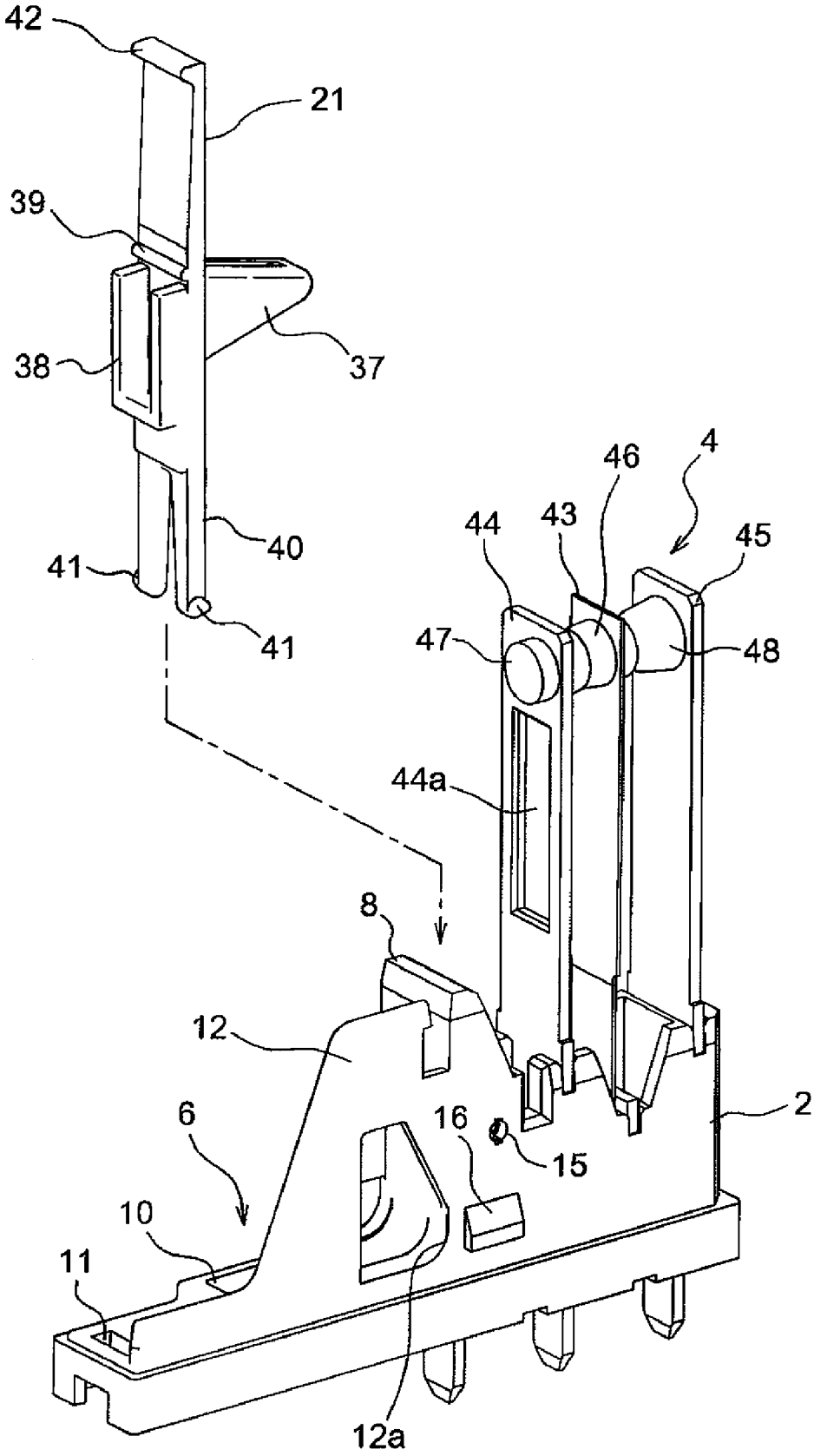

【Fig. 10】
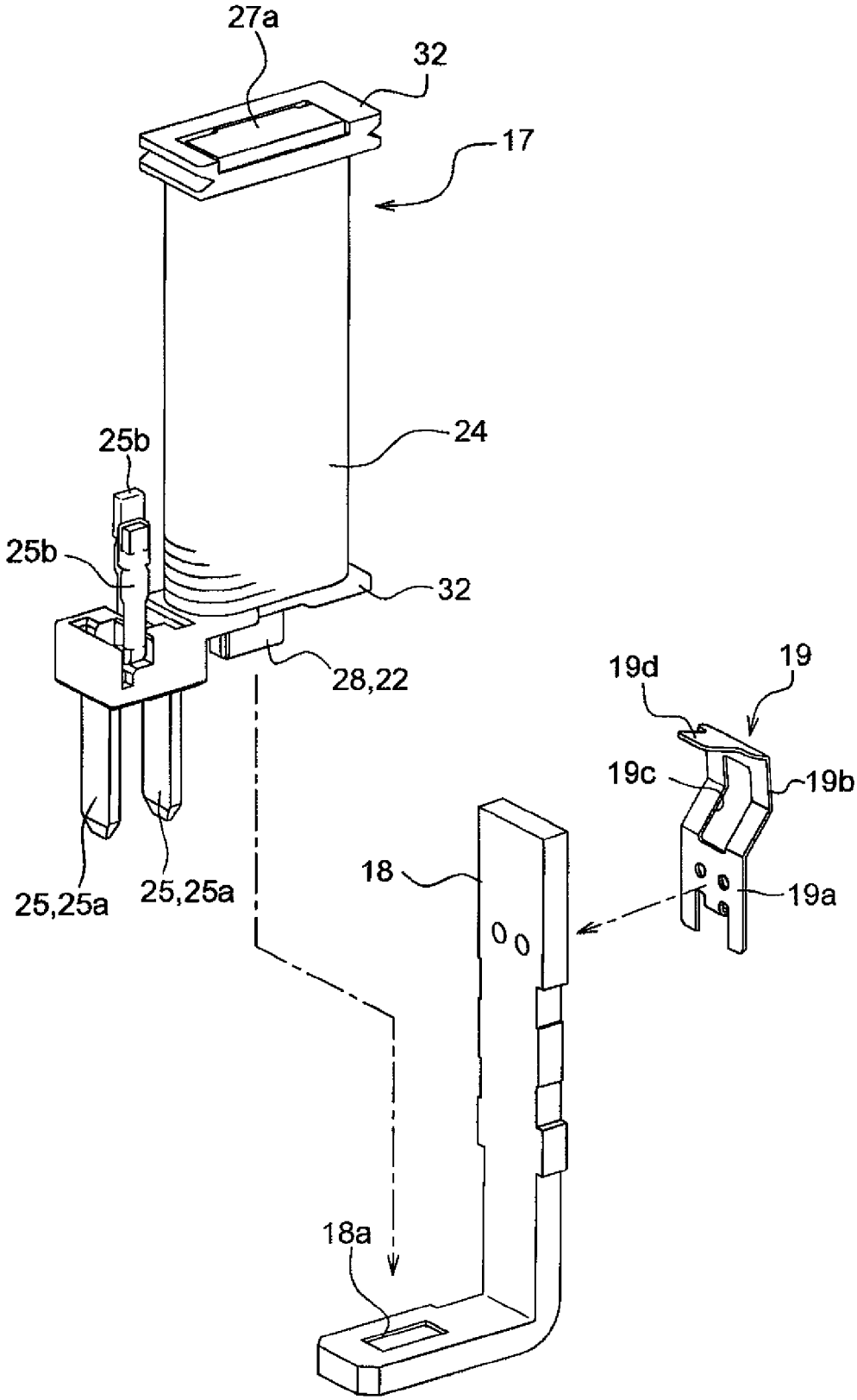

【Fig. 11】
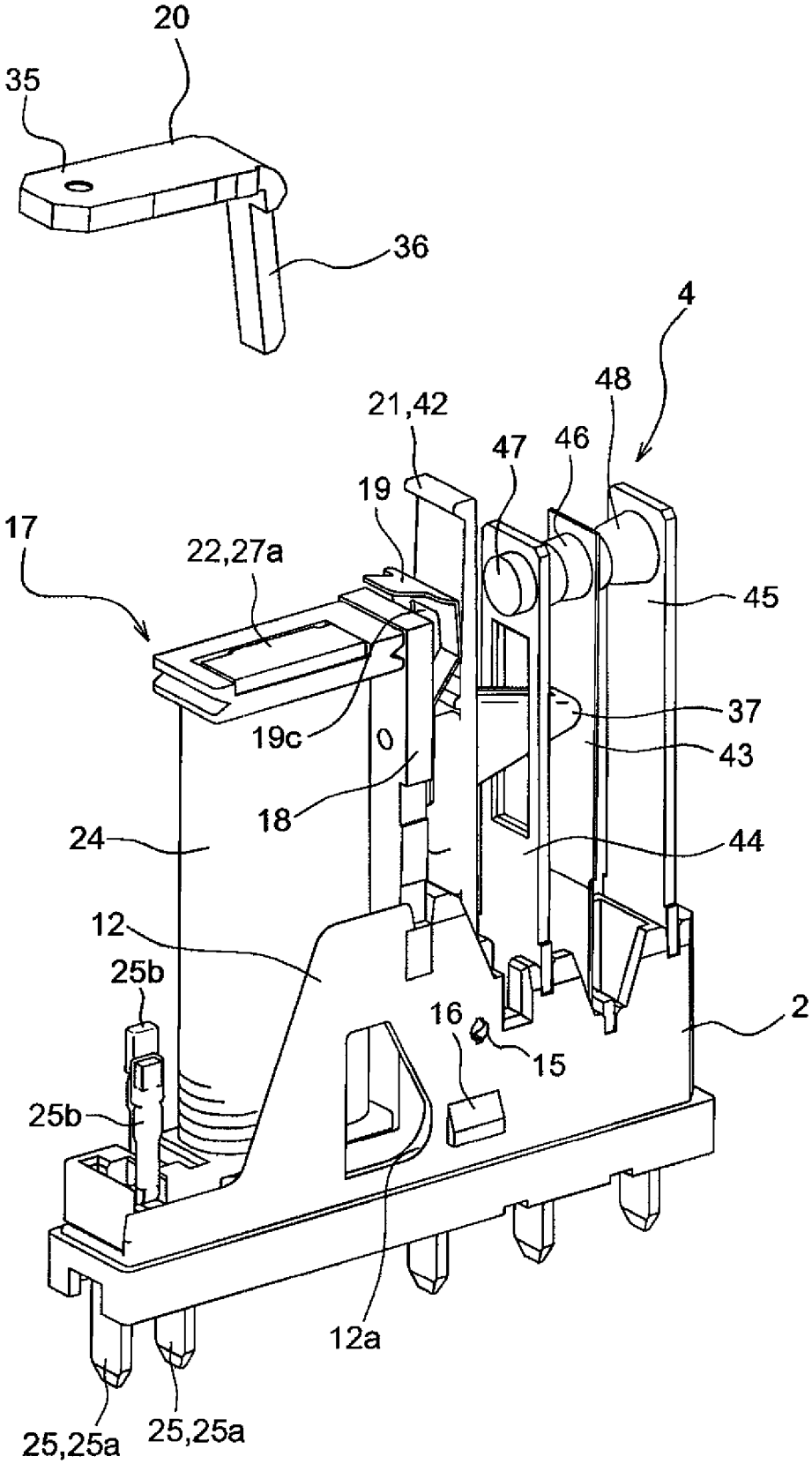

【Fig. 12】
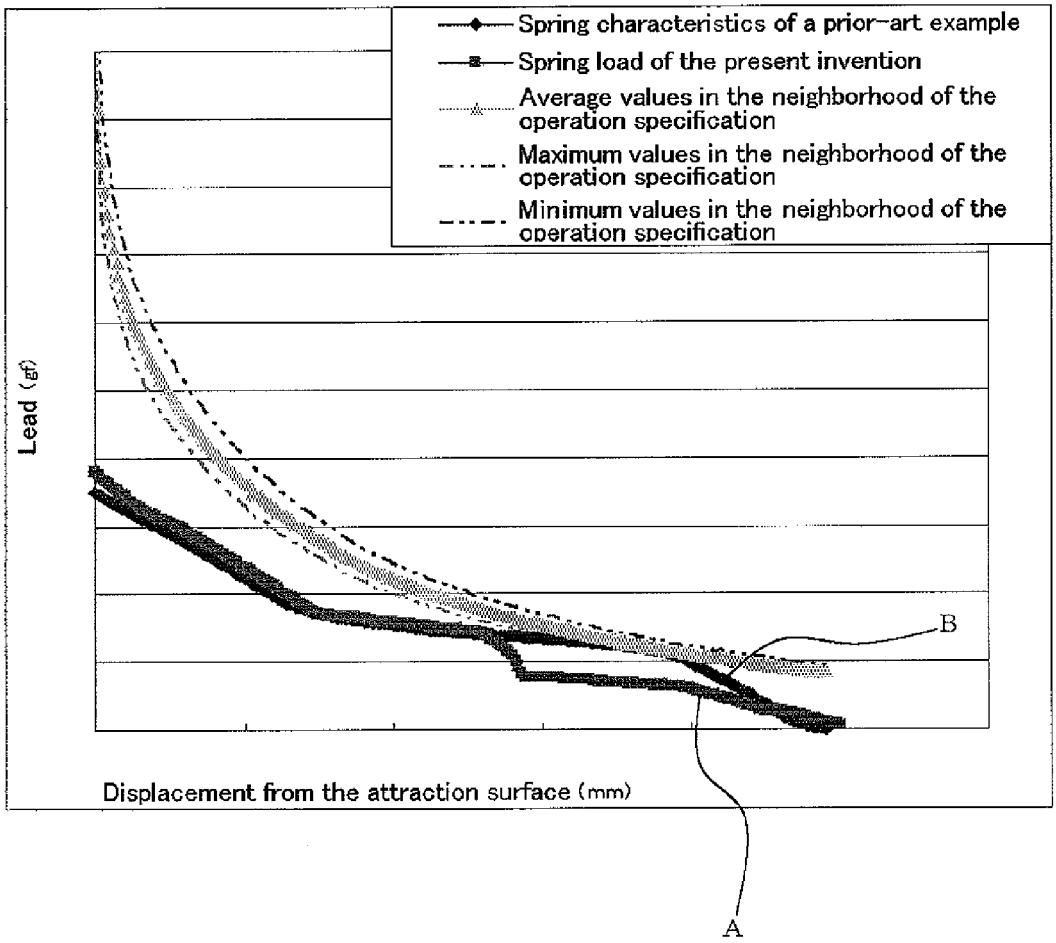
【Fig. 13】
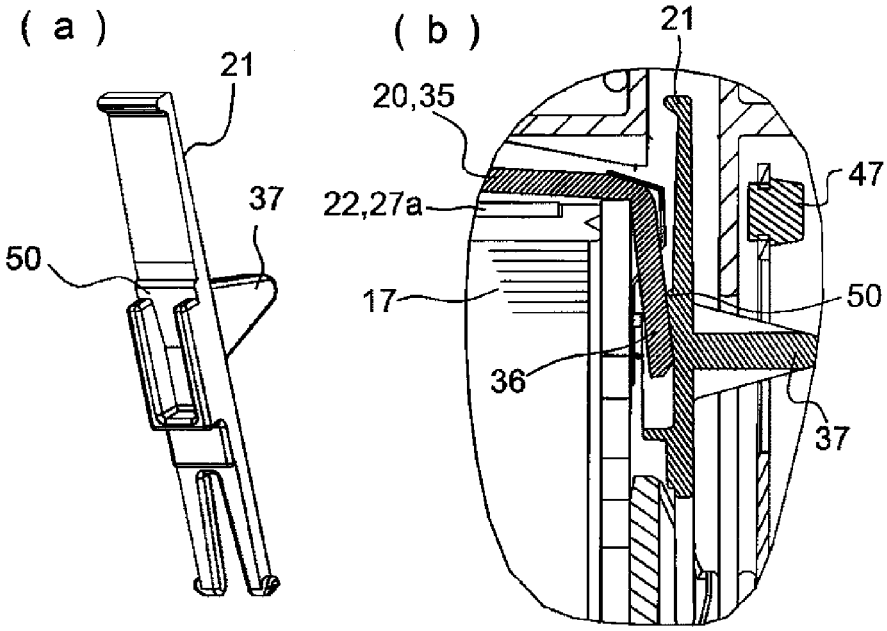

【Fig. 14】
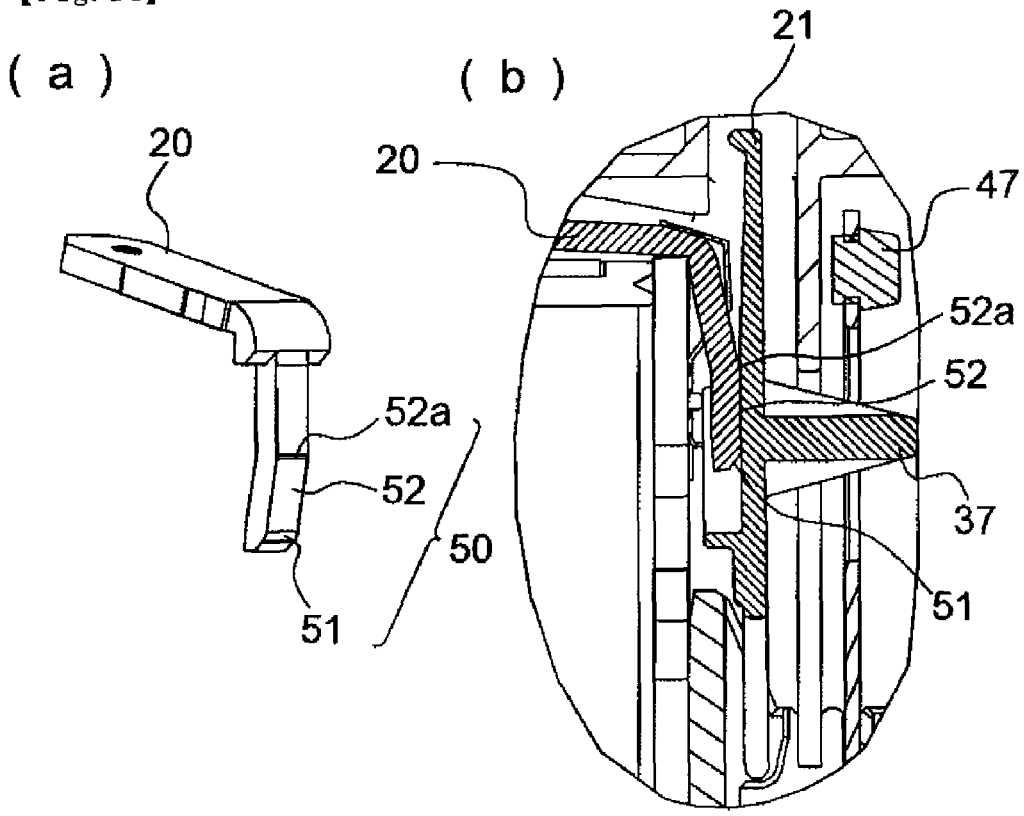
【Fig. 15】
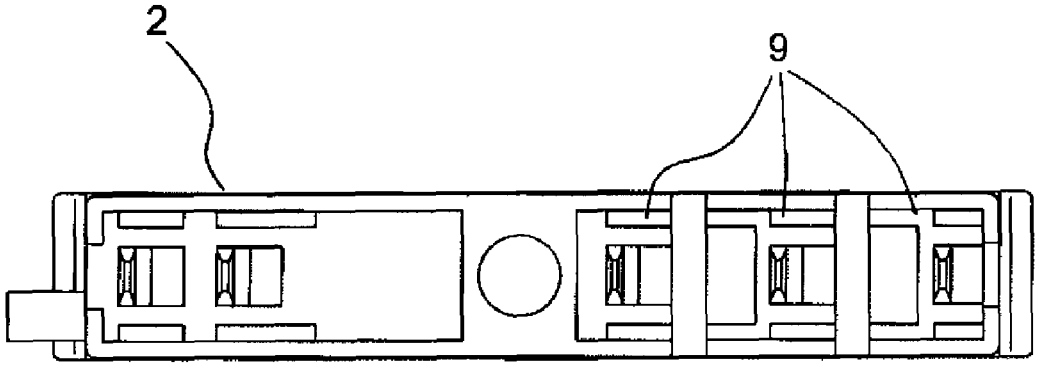

【Fig. 16】
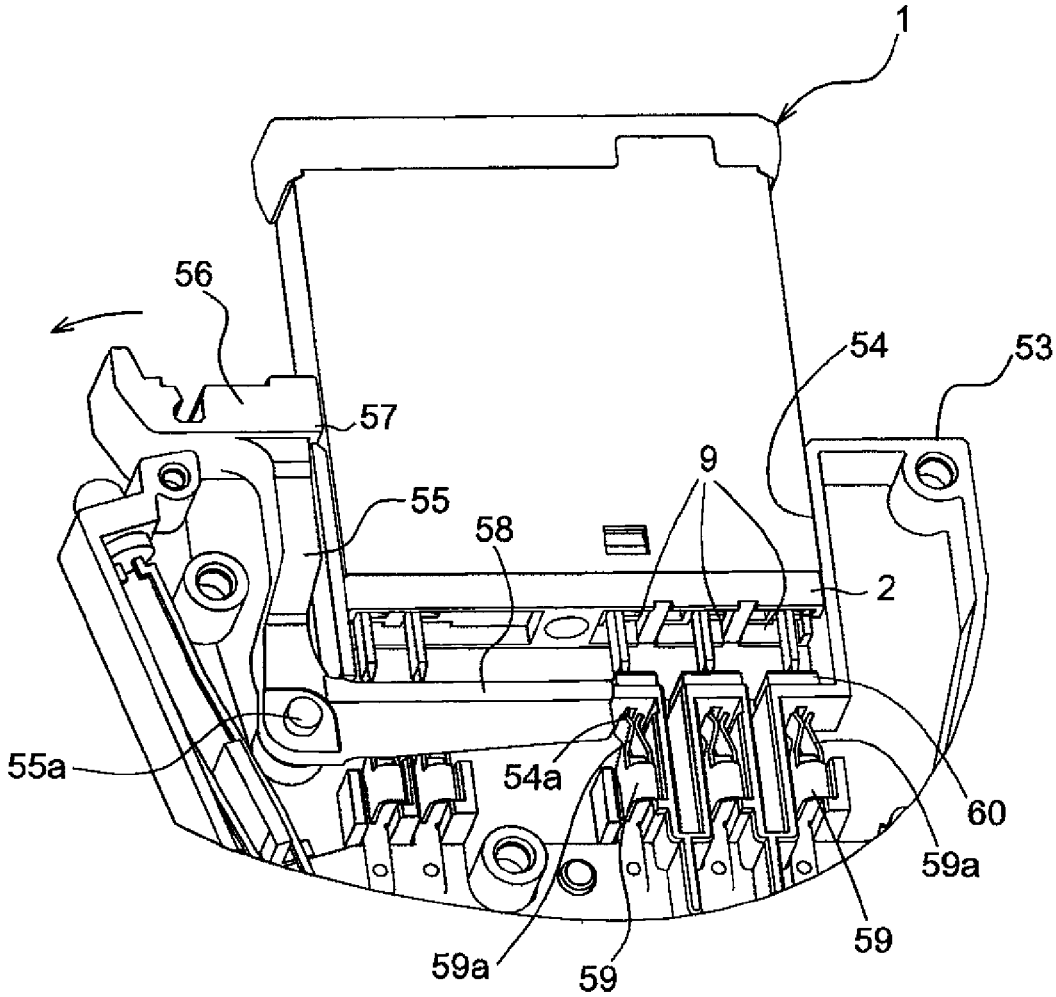

ELECTROMAGNETIC RELAY

TECHNICAL FIELD

The present invention relates to an electromagnetic relay, in particular to an electromagnetic relay that can achieve desired operation characteristics even if it has a small thickness.

BACKGROUND ART

Conventionally, as an electromagnetic relay, for example, there is one in which a movable iron piece is rotated by excitation or non-excitation of an electromagnet, a movable contact piece is elastically deformed through a card, and a movable contact opens and closes fixed contacts of fixed contact pieces that are oppositely disposed (e.g., Patent Document 1).

Patent Document 1: JP2004-327236A

DISCLOSURE OF INVENTION

Problem to be Solved by the Invention

Incidentally, there has been a demand for a reduction in thickness in electromagnetic relays of the above type, and it was similarly required that electromagnets be formed thin.

However, if an electromagnet is formed thin, the number of windings of a coil is restricted because of the thin electromagnet. Thus, an attraction force is reduced if a voltage is applied at a voltage value similar to that of the conventional electromagnetic relay, so that desired operation characteristics are not obtained.

It is an object of the present invention to provide an electromagnetic relay that can achieve desired operation characteristics by simple and inexpensive construction even if it has a small thickness.

Means of Solving the Problem

As a means of solving the problem, the present invention provides an electromagnetic relay wherein a movable iron piece is rotated by excitation or non-excitation of an electromagnet, a movable contact piece is elastically deformed by the movable iron piece through a card, and a movable contact provided on the movable contact piece opens and closes fixed contacts of fixed contact pieces disposed facing the movable contact piece, wherein the movable iron piece is provided with a card pressing portion capable of pressing the card;

the card is provided with a contact piece pressing portion capable of pressing the movable contact piece by being rotated around a fulcrum;

a press position changing portion provided on at least one of the movable iron piece and the card, wherein when rotating the movable iron piece, force transmission from the movable iron piece to the card is performed at a position more distant from a press position by the card pressing portion of the movable iron piece with respect to the fulcrum and then performed by the card pressing portion.

With this construction, when the electromagnet is excited or non-excited to rotate the movable iron piece, because of the press position changing portion, the movable iron piece first presses the card at a position more distant from the card pressing portion of the movable iron piece with respect to the fulcrum. Thereby, an attraction force of attracting the movable iron piece by the electromagnet requires a smaller force compared with the case where the card pressing portion presses the card. Then, when the movable iron piece approaches the attraction surface of the electromagnet and the attraction force is increased, the card can be pressed by the card pressing portion. In this manner, it is possible to reduce the force required for elastically deforming the movable contact piece through the card during initial driving of the movable iron piece by the electromagnet. That is, with respect to an attraction force curve showing a relationship between a distance between the attraction surface of the electromagnet and a portion to be attracted of the movable iron piece (stroke) and an attraction force of the electromagnet, a force required for elastically deforming the movable contact piece can sufficiently be reduced. Therefore, even if the attraction force is reduced because the number of windings of a coil is reduced by reducing the thickness of the electromagnet, it becomes possible to appropriately rotate the movable iron piece and elastically deform the movable contact piece through the card.

The press position changing portion may be formed of a protruding portion provided on at least any one of the movable iron piece and the card. In particular, if the protruding portion is formed on the resin-made card, it is possible to obtain both of the protruding portion and the card simultaneously when molding the card. This is preferred in that it becomes possible to cope with the manufacturing simply and inexpensively.

The press position changing portion may be provided with a surface contact portion where a part of the movable iron piece and a part of the card come into surface contact with each other. It is preferred that a surface contact with the surface contact portion is obtained in the middle of rotation of the movable iron piece accompanied by excitation of the electromagnet. With this construction, when the movable contact comes in contact with another fixed contact in the middle of rotation of the movable iron piece, a surface contact state by the surface contact portions can be obtained. Therefore, even if the contacts are separated, it becomes possible to perform displacement of the card and the movable contact piece in a stable state.

The press position changing portion may be provided on at least any one of the movable iron piece and the card, and may be formed of a curved surface which gradually displaces a contact position to the fulcrum side.

With this construction, since the press position is gradually displaced as the movable iron piece is rotated, it is possible to prevent an elastic force of the movable contact piece that acts on the movable iron piece through the card from rapidly changing, and it becomes possible to rotate the movable iron piece smoothly.

The fulcrum of the card may be provided with a pair of shaft portions which are coaxially disposed, each of the shaft portions may be provided at each of bifurcated elastic deforming portions, and, by elastic deformation of the elastic deforming portions, the shaft portions may be engaged in shaft-receiving holes provided in a base on which the electromagnet is placed so as to be freely rotatably supported.

With this construction, it is possible to simply attach the card to the base. Moreover, it becomes possible to stabilize rotation of the card. Therefore, it becomes possible to smoothly and reliably perform changing of the press position by the press position changing portion accompanied by rotation of the movable iron piece. Accordingly, it is possible to easily obtain operation characteristics as designed.

Effect of the Invention

According to the present invention, force transmission from the movable iron piece to the card is performed by the press position changing portion at a position more distant from a press position by the card pressing portion of the movable iron piece with respect to the fulcrum and then performed by the card pressing portion. Therefore, not that large of an attraction force is required during initial driving of the electromagnet, and even in the case where the electromagnet has a small thickness and smaller attraction force compared with those of the conventional electromagnet, it is possible to smoothly rotate the movable iron piece and elastically deform the movable contact piece through the card.

BRIEF DESCRIPTION OF DRAWINGS

FIG. 1 is an exploded perspective view showing a state in which a case is removed from a base of an electromagnetic relay according to the present embodiment;

FIG. 2 is a front cross sectional view of the electromagnetic relay according to the present embodiment;

FIG. 3 is a partially enlarged view of FIG. 2;

FIG. 4 is a view showing a state in which a card is slightly rotated from a state of FIG. 3 by exciting an electromagnet;

FIG. 5 is a view showing a state in which the card is further rotated from the state of FIG. 4, so that a movable contact comes in contact with a second fixed contact;

FIG. 6 is a view showing a state in which the card is further rotated from the state of FIG. 5, so that the movable contact comes into press contact with the second fixed contact;

FIG. 7 is an exploded perspective view showing an electromagnet of FIG. 1;

FIG. 8 is an exploded perspective view showing a base and respective contact pieces of FIG. 1;

FIG. 9 is an exploded perspective view showing a state in which the card is assembled from a state of FIG. 8;

FIG. 10 is an exploded perspective view showing the electromagnet, a yoke and a hinge spring;

FIG. 11 is an exploded perspective view showing a state in which a movable iron piece is assembled;

FIG. 12 is a graph showing a relationship between a distance between a magnetic pole surface of an iron core and an attraction portion of the movable iron piece and a spring force received from a movable contact piece due to differences in attractive force of the electromagnet and press position;

FIG. 13(*a*) is a perspective view showing a card according to another embodiment, and FIG. 13(*b*) is a partial cross sectional view showing a state in which the card is incorporated;

FIG. 14(*a*) is a perspective view showing a movable iron piece according to another embodiment, and FIG. 14(*b*) is a partial cross sectional view showing a state in which the movable iron piece is incorporated;

FIG. 15 is a bottom view of a base according to the present embodiment; and

FIG. 16 is a partially broken perspective view showing a state in which the electromagnetic relay according to the present embodiment is being assembled to a socket.

DESCRIPTION OF THE NUMERALS

1 electromagnetic relay
2 base
3 electromagnetic block
4 contact opening/closing members
5 case
6 electromagnetic block attaching portion
7 contact opening/closing members attaching portion
8 partition wall
9 fitting recesses
10 escaping recess
11 terminal holes
12 guide wall
13 guide piece
14 contact piece press fitting portions
15 shaft-receiving holes
16 hooking pawls
17 electromagnet
18 yoke
19 hinge spring
20 movable iron piece
21 card
22 iron core
23 spool
24 coil
25 coil terminals
26 plate shaped portion
27 magnetic pole portion
28 press fitting portion
29 guide grooves
30 positioning recesses
31 body portion
32 flange portions
33 connection portions
34*a*, 34*b* projections
35 attraction portion
36 card pressing portion
37 contact piece pressing portion
38 guide receiving portion
39 protruding portion
40 elastically deforming portion
41 shaft portions
42 indicator portion
43 movable contact piece
44 first fixed contact piece
46 movable contact
47 first fixed contact
48 second fixed contact
49 cover
50 surface contact portion
51 first pressing surface
52 second pressing surface
53 socket
54 recess
55 arm member
56 operation portion
57 hooking portion
58 push-out portion

BEST MODE FOR CARRYING OUT THE INVENTION

An embodiment of the present invention will hereinafter be described with reference to the accompanying drawings.

<Construction>

FIG. 1 shows an electromagnetic relay 1 of the present embodiment. The electromagnetic relay 1 is generally constructed of a base 2, an electromagnetic block 3, contact opening/closing members 4 and a case 5.

As shown in FIG. 8, the base 2 includes an electromagnetic block attaching portion 6 where the electromagnetic block 3 is provided and a contact opening/closing members attaching portion 7 where the contact opening/closing members 4 are provided. The electromagnetic block attaching portion 6 and the contact opening/closing members attaching portion 7 are partitioned by a partition wall 8. Further, as shown in FIG. 15 and FIG. 16, a bottom surface of the base 2 is formed with a plurality of fitting recesses 9 (three places here). In the fitting recesses 9, protruding portions 60 provided on a socket side for connecting the electromagnetic relay 1 are detachably engaged.

The electromagnetic block attaching portion 6 is formed with an escaping recess 10 in which a lower end portion of an iron core 22 described below is located (refer to FIG. 2). Further, terminal holes 11 are formed laterally (in a lengthwise direction) in two places of the escaping recess 10. A guide wall 12 that is continuous with a side surface of the contact opening/closing members attaching portion 7 is formed on one side in a widthwise direction of the electromagnetic block attaching portion 6, and a guide piece 13 is formed on the remaining one side (FIG. 8). The guide wall 12 is formed with an opening 12*a*. A wide portion on one side of the electromagnetic block 3 described below is guided by the guide wall 12, and a part of a yoke 18 is guided by the guide piece 13. That is, the electromagnetic block 3 is guided laterally (in a widthwise direction).

As shown in FIG. 8, contact piece press fitting portions 14, into each of which each contact piece described below is press fitted, are formed in three places of the contact opening/closing members attaching portion 7. Shaft-receiving holes 15 are formed in both side walls, which are extended from the partition wall 8. Hooking pawls 16 for fitting the case 5 are protrusively provided at lower sides of the shaft-receiving holes 15 of outer surfaces of both the side walls.

As shown in FIG. 2, the electromagnetic block 3 is constructed of an electromagnet 17, the yoke 18, a hinge spring 19, a movable iron piece 20 and a card 21.

As shown in FIG. 7, the electromagnet 17 is formed by winding a coil 24 around a body portion 31 of a spool 23 into which an iron core 22 is inserted, and coil terminals 25, 25 for respectively winding both end portions of the coil 24 are attached to a flange portion 32 of the spool 23.

As shown in FIG. 7, the iron core 22 is constructed of a plate shaped portion 26 made of a thin magnetic plate material (here, length×width×thickness=22×4×1 (mm)). A magnetic pole portion 27 is formed on one end side of the plate shaped portion 26, and a press fitting portion 28 is formed on the other end side thereof. Both edge portions of both surfaces (each corner portion of a rectangular surface in cross section) of the plate shaped portion 26 are formed with guide grooves 29 each formed by being cut into a step shape. Further, a positioning recess 30 is formed in the center of each of both side portions of the plate shaped portion 26. The magnetic pole portion 27 is obtained by laterally bending one end portion of the magnetic plate material. A magnetic surface 27*a* is obtained by removing an upper surface of the magnetic pole portion 27 by cutting and the like so that a circular arc surface of the bent portion is almost eliminated. Further, the press fitting portion 28 is formed by reducing a width of the other end portion of the magnetic plate material. The press fitting portion 28 is press fitted into a press fitting hole 18*a* formed in the yoke 18 (FIG. 10).

As shown in FIG. 7, the spool 23 is obtained by forming a synthetic resin material, and it consists of the body portion 31, and the flange portions 32 formed at both end portions of the body portion 31. The body portion 31 is constructed of connection portions 33, 33 provided in parallel at a predetermined interval so that the iron core 22 is disposed. Projections 34*a*, 34*b* are respectively formed on both edge portions of opposite surfaces of the connection portions 33. The projections 34*a* are provided on edge portions excluding a central portion of one side thereof, and the projection 34*b* is provided on the remaining one side thereof. The projections 34*a* and 35*b* are engaged with the guide grooves 29 of the iron core 22 so as to guide the iron core 22. Thereby, even if the body portion 31 is constructed of only the pair of the connection portions 33, 33, it is possible to appropriately guide the iron core 22. Further, positioning projections 33*a* are formed at central portions of the opposite surfaces of the connection portions 33, and they are engaged in the positioning recesses 30 of the iron core 22, whereby the iron core 22 is positioned in its axial direction with respect to the spool 23. A central portion of an upper end surface of an upper end flange portion 32 is formed with a communication hole 32*a* communicating with a space between the connection portions 33, 33. An upper surface of the upper end flange portion 32 is formed with a groove portion 32*b* continuous with the communication hole 32*a*, and the magnetic pole portion 27 of the iron core 22 is disposed. Roughly V-shaped grooves 32*c* are formed in a widthwise direction in central portions of end surfaces of the upper end flange portion 32. The grooves are provided for an automated machine. A lower end flange portion 32 is formed with a similar communication hole 32*a* and a groove portion (not shown). However, one end portion of the yoke 18 is placed in the groove portion. The lower end flange portion 32 is extended laterally, where terminal holes 32*d*, 32*d* are formed in two places.

The coil 24 is formed using an automated machine by winding a coil wire around the body portion 31 of the spool 23 into which the iron core 22 is inserted.

As shown in FIG. 7, each coil terminal 25 includes a terminal portion 25*a* and a coil wire winding portion 25*b*. Each of the terminal portions 25*a* is press fitted into each terminal hole 32*d* formed in the lower end flange portion. After both end portions of the coil wire, which is wound around the body portion 31 of the spool 23, are wound respectively around the coil terminals 25*b*, they are bent and raised.

As shown in FIG. 10, the yoke 18 is formed by bending a magnetic material into a roughly L-shape. The hinge spring 19 is fixed by caulking to one end portion (upper end portion) of the yoke 18. The press-fitting hole 18*a* is formed in the other end portion (lower end horizontal portion) of the yoke 18, into which the press fitting portion 28 of the iron core 22 is press fitted.

The hinge spring 19 is formed of an attachment portion 19*a* that is fixed by caulking to one end portion of the yoke 18, and an elastic support portion 19*b* that is bent and extended from the attachment portion 19*a*. Attachment openings for caulking are formed in two places of the attachment portion 19*a*. A central portion of the elastic support portion 19*b* is formed with a rectangular opening 19*c*, and an end portion thereof is extendedly provided with a support piece 19*d*.

As shown in FIG. 11, the movable iron piece 20 is formed by bending a magnetic plate material at its center portion, and the bent portion is rotatably supported by one end portion (upper end fulcrum) of the yoke 18. One end portion of the movable iron piece 20 serves as an attraction portion 35 and is attracted to the magnetic pole surface 27*a* of the iron core 22. The other end portion of the movable iron piece 2 has a width smaller than that of the attraction portion 35 and constructs a pressing portion 36 that is extended passing through the rectangular opening 19*c* in a state of being rotatably supported by the yoke 18.

The card 21 is obtained by forming a synthetic resin. As shown in FIG. 9, a central portion of one surface (front surface) of a plate material is formed with a contact piece pressing portion 37, and a central portion of the remaining one surface (back surface) is formed with a guide receiving portion 38. The contact piece pressing portion 37 roughly has a triangular shape, and a center portion of each of upper and lower inclined surfaces is formed with a groove, and its end portion is a curved contact surface. The guide receiving portion 38 roughly has a U-shape, in which the card pressing portion 36 of the movable iron piece 20 is positioned and guided. A protruding portion 39 is formed in the vicinity of an upper portion of the guide receiving portion 38. The protruding portion 39 is formed to have a height so that the card pressing portion 36 of the movable iron piece 20 comes in contact with the protruding portion 39 before the card 21 is pressed by a contact surface of the movable iron piece 20. That is, it is configured that when the movable iron piece 20 is rotated, the protruding portion 39 first comes in contact with the movable iron piece 20 so that the card 21 is pressed. A lower end portion of the plate material forms elastic deforming portions 40 that are bifurcated. An end portion (lower end portion) of each elastic deforming portion 40 is provided with a shaft portion 41 laterally protruding therefrom. If the shaft portions 41 are engaged in the shaft-receiving holes 15 in the base 2, while elastically deforming the elastic deforming portions 40 in mutually approaching directions, the card 21 is freely rotatably supported by the base 2 around the shaft portions 41. An upper end portion of the plate material is formed with a perpendicularly bent indicator portion 42. The indicator portion 42 serves as what is called an indicator, which informs a driving state by being formed at a position distant from the rotation center to increase a moving distance of the card 21 even if a rotational angle of the card 21 is small.

As shown in FIG. 8, the contact opening/closing members 4 are constructed of a movable contact piece 43 and two fixed contact pieces (a first fixed contact piece 44 and a second fixed contact piece 45) disposed on both sides thereof. The movable contact piece 43 is obtained by fixing by caulking a separate terminal portion 43*b* to a lower end portion of a contact piece portion 43*a*. An upper end portion of the contact piece portion 43*a* is formed with a through hole, where a movable contact 46 is fixed by caulking. The movable contact 46 is formed on both surfaces of the contact piece portion 43*a*, and are contacted with and separated from the respective fixed contacts of the first fixed contact piece 44 and the second fixed contact piece 45. The terminal portion 43*b* is bent in a step shape so that a protruding position from a lower surface of the base 2 is adjusted. An upper side of the first fixed contact piece 44 is formed with a rectangular opening 44*a*, and a first fixed contact 47 is fixed by caulking to an upper portion thereof. A lower end side of the first fixed contact piece 44 is bent in a step shape in the same manner as in the terminal portion. The second fixed contact piece 45 has a strip shape, and a second fixed contact 48 is fixed by caulking to an upper end portion thereof.

As shown in FIG. 1, the case 5 is obtained by forming a material with light permeability into a box shape with an opening in its lower end surface. A central portion of one side end surface of the case 5 is protrusively formed with a hooking pawl 5*a*, and both side surfaces of the case 5 are each formed with a hooking hole 5*b*. The hooking pawls 16 formed in the base 2 are engaged with the respective hooking holes 5*b*. Further, a cover 49 is detachable to an upper surface of the case 5. The cover 49 is for adding an additional function, and depending on the function that is required, and an accessory such as an indicator is provided. That is, if the additional function is required, the cover 49 on which an accessory for that purpose is mounted is attached. However, in the above embodiment, the cover 49 is a dummy, and no accessory is mounted. In addition, reference numeral 49*a* denotes a viewing window for making it possible to visually check the indicator portion 42 when the card 21 is rotated.

<Assembly>

Next, an assembling method of the electromagnetic relay 1 will be described.

First, the electromagnet 17 and the contact opening/closing members 4 are formed. For formation of the electromagnet 17, as shown in FIG. 7, the iron core 22 is inserted between the connection portions 33, 33 through the communication holes 32*a*, 32*a* formed in the upped and lower end flange portions 32, 32, respectively. In this case, since the iron core 22 is guided by engaging of the respective projections 34*a*, 34*b*, which are formed on the connection portions 33, with the guide grooves 29 of the iron core 22, it is possible to smoothly attach the iron core 22 between the connection portions 33, 33. The connection portions 33, 33 are respectively elastically deformed halfway through in mutually separating directions due to their positioning projections 33*a*. Then, the positioning projections 33*a* of the connection portions 33 are engaged with the positioning recesses 30 of the iron core 22, whereby the iron core 22 is position-restricted also in a lengthwise direction with respect to the spool 23. At this time, completion of positioning provides a user with a clicking sensation accompanied by a shape returning operation of the connection portions 33. Therefore, it becomes possible to reliably recognize that the iron core 22 was able to be positioned with respect to the spool 23. Further, the coil terminals 25*b* are press fitted into the terminal holes 32*d* of the lower end flange portion 32. In a press fitted state, the coil wire winding portions 25*b* of the respective coil terminals 25 are laterally extended (in mutually separating directions). Subsequently, a coil wire is wound around the body portion 31 of the spool 23. Although the coil wire is wound by an automated machine, since the coil wire winding portions are laterally extended so that they do not become a hindrance to automated winding. When winding of the coil wire on the body portion 31 is completed, both of the end portions of the coil wire are respectively wound around the coil wire winding portions, and the coil wire winding portions are bent and raised. Further, as shown in FIG. 10, the yoke 18 to which the hinge spring 19 is fixed by caulking is attached. The yoke 18 is attached by inserting the press fitting portion 28 of the iron core 22 into the press fitting hole 18*a* in the lower end horizontal portion. On the other hand, in the contact opening/closing members 4, the respective contact pieces are obtained by punching a lead frame and fixing the contacts by caulking. However, the movable contact piece 43 is completed by fixing the contact piece portion 43*a* and the terminal portion 43*b* by caulking.

Next, the contact opening/closing members 4 are attached to the base 2. That is, as shown in FIG. 8, the respective contact pieces are press fitted into the corresponding contact piece press fitting portions 14, whereby the movable contact piece 43 is disposed between the first fixed contact piece 44 and the second fixed contact piece 45. In this state, the movable contact 46 faces the second fixed contact 48 so that they can come in contact with or be separated from each other, and the movable contact 46 closes the first fixed contact 47.

Subsequently, as shown in FIG. 9, the card 21 is attached to the base 2. The card 21 is inserted between side walls of the base, while elastically deforming the elastic deforming portions 40 at a lower end side thereof, so that they approach each other. Then, the shape of the elastic deforming portions 40 is returned, and the shaft portions 41 are engaged in the shaft-receiving holes 15, whereby attachment of the card 21 to the base 2 is completed. In this state, the protruding portion 39 of the card 21 is protruded to the movable contact piece 43 side through the rectangular opening 44*a* of the first fixed contact piece 44.

Further, the electromagnetic block 3 is attached to the base 2. That is, while press-fitting the coil terminals 25 into the terminal holes 11 in the base 2, the electromagnet 17 is placed on the electromagnetic block attaching portion 6. One side of the electromagnet 17 is guided by the guide wall 12, and the remaining one side is guided by the guide piece 13, so that the electromagnetic block 3 is position-restricted in a widthwise direction. Further, the coil terminals 25 are press fitted into the terminal holes 11, and the yoke 18 is guided by the partition wall 8 so that the electromagnetic block 3 is position-restricted in a lengthwise direction.

After completion of the electromagnetic block 3, as shown in FIG. 11, the movable iron piece 20 is attached. An inner surface side of the movable iron piece 20 is supported by an upper end portion of the yoke 18, and an outer surface side of the bent portion is supported by the hinge spring 19. Further, the card pressing portion 36 of the movable iron piece 20 comes in contact with the card 21 through the rectangular opening 19*c* of the hinge spring 19. In this attachment state, the movable iron piece 20 is pressed by the protruding portion 39 of the card 21, which is pressed by a spring force of the movable contact piece 43, and the attraction portion 35 is positioned in a manner so as to be separated from the magnetic pole surface 27*a* of the iron core 22.

After that, as shown in FIG. 1, the case 5 provided with the cover 49 is attached to the base 2, whereby an assembling work is completed. The case 5 is fitted to outer surfaces of the base 2, whereby the hooking pawls 16 formed on both the side surfaces of the base 2 are engaged with the hooking holes 5*b*, so that the case 5 is prevented from coming off. As required, the cover 49 with an accessory may be used.

<Operation>

Subsequently, an operation of the electromagnetic relay 1 will be described.

In a non-excited state in which a voltage is not applied to the electromagnet 17, as shown in FIG. 3, the movable contact piece 43 is kept in an upright state by its spring force, and the movable contact 46 closes the first fixed contact 47. Further, the contact piece pressing portion 37 of the card 21 is pushed back by the movable contact piece 43 and held in a rotated state in a counterclockwise direction around the shaft portions 41. In this state, the protruding portion 39 of the card 21 comes in contact with the movable iron piece 20, the movable iron piece 20 is rotated in a clockwise direction around a fulcrum (the upper end portion of the yoke 18), and the attraction portion 35 is separated from the magnetic pole surface 27*a* of the iron core 22.

When a voltage is applied to the electromagnet 17 to excite the electromagnet 17, as shown in FIG. 4, the attraction portion 35 of the movable iron piece 20 is attracted to the magnetic pole surface 27*a* of the iron core 22, so that the movable iron piece 20 is rotated in a counterclockwise direction around the rotation fulcrum. While the movable iron piece 20 is rotated a predetermined angle, the card pressing portion 36 of the movable iron piece 20, more specifically not an end portion thereof but a front surface distant from the end portion presses the protruding portion 39 of the card 21. Thereby, the card 21 is rotated in a clockwise direction around the shaft portions 41, and the contact piece pressing portion 37 thereof presses the movable contact piece 43 against its spring force.

When the movable iron piece 20 is rotated to some extent, as shown in FIG. 5, after the movable contact 46 has been separated from the first fixed contact 47, the card pressing portion 36 presses the card 21 (not the protruding portion 39 but an inner surface of the guide receiving portion 38) with its end portion. Thereby, the movable contact piece 43 is further elastically deformed, so that the movable contact 46 closes the second fixed contact 48. In a state in which the attraction portion 35 of the movable iron piece 20 is attracted to the magnetic pole surface 27*a* of the iron core 22, as shown in FIG. 6, the movable contact 46 comes into press contact with the second fixed contact 48, so that a desired contact pressure between the contacts is obtained.

As described above, in the electromagnetic relay wherein the card 21 is formed with the protruding portion 39, an action point is located at the protruding portion 39 distant from the shaft portions 41, which are the rotation center of the card 21 during initial rotation, so that it is possible to rotate the card 21 with a small force. Therefore, even in a state in which a sufficient attraction force is not obtained during initial driving of the electromagnet 17, it becomes possible to reliably rotate the card 21. (In a graph of FIG. 12, suppose that a change of a region where a spring load of the present invention suddenly changes is referred to as A. Suppose that a change of a corresponding region in spring characteristics of a prior-art example is referred to as B. The change A remains at a lower side of the change B. Therefore, even if there is a variation in the attraction force of an electromagnet, it is possible to elastically deform the movable contact piece.) Accordingly, even if the electromagnet 17 is thin as described above, and a sufficient attraction force cannot be expected, it becomes possible to achieve a desired initial operation. Then, after the movable iron piece 20 has been rotated to some extent, the action point is moved from the protruding portion 39 into the guide receiving portion 38 in the vicinity of the shaft portions 41. In this case, since the attraction portion 35 of the movable iron piece 20 approaches the magnetic pole surface 27*a* of the electromagnet 17, a sufficient attraction force is obtained, so that a rotational operation of the movable iron piece 20 and the card 21 is not hampered.

Another Embodiment

In the above embodiment, the card 21 is formed with the protruding portion 39, and it is also possible to form the protruding portion on the movable iron piece 20. Formation of the protruding portion 39 on the movable iron piece 20 may be performed by using press work and the like or by separately attaching a resin material, a metal material and the like by means of bonding, pressure bonding and the like. It is also possible to form the protruding portion 39 on both of the card 21 and the movable iron piece 20 so that the protruding portions come in contact with each other.

Further, in place of the protruding portion 39, a surface contact portion 50 may be formed as shown in FIG. 13 and FIG. 14.

In FIG. 13, the surface contact portion 50 is configured to have an inclined surface formed on a back surface of the card 21. According to this construction, in the middle of rotation of the movable iron piece 20 accompanied by excitation of the electromagnet 17, more particularly when the movable contact comes in contact with another fixed contact, the front surface of the card pressing portion 36 of the movable iron piece 20 comes into surface contact with the inclined surface of the surface contact portion 50. Therefore, an operation state of the card 21 when the movable contact comes in contact with another fixed contact can be stabilized.

When the electromagnet 17 is excited, the attraction portion 35 of the movable iron piece 20 is attracted to the magnetic pole portion 27*a* of the iron core 22 and rotated, so that the card pressing portion 36 presses the card 21. The movable iron piece 20 presses the card 21 through an upper end portion of the surface contact portion 50 during the initial stage of driving the electromagnet 17. Then, as the card 21 is rotated around the shaft portions 41, the movable contact 46 is separated from the first fixed contact 47, and the movable contact piece 43 is in a state of being supported only by the movable iron piece 20 through the card 21. At this time, a press position of the card 21 by the movable iron piece 20 is changed from the upper end portion of the surface contact portion 50, 50 that the front surface of the movable iron piece 20 comes into surface contact with the surface contact portion 50. Therefore, the card 21 and the movable contact piece 43 are displaced in a stable state. After that, the press position of the card 21 by the movable iron piece 20 is moved from the front surface of the card pressing portion 36 to the end portion thereof, and the movable contact 46 closes the second fixed contact 48. In this manner, the action point is moved from the upper end portion of the surface contact portion 50 to the side of the shaft portions 41 that is the rotation center of the card 21. Therefore, even if an initial driving force of the electromagnet 17 is small, it is possible to rotate the card 21 sufficiently and elastically deform the movable contact piece 43.

Further, in FIG. 14, the card pressing portion 36 of the movable iron piece 20 is bent (or cut, ground etc.) halfway whereby a first pressing surface 51 and a second pressing surface 52 are provided. The surface contact portion 50 is constructed of both of the pressing surfaces 51, 52. Also with this construction, the same effect as the construction shown FIG. 13 is obtained. That is, during initial driving of the electromagnet 17 by excitation, the card 21 is pressed by an upper boundary portion 52*a* of the second pressing surface 52 of the movable iron piece 20. Then, after having being pressed by the second pressing surface 52, the card 21 is pressed by the first pressing surface 51. According to this construction, in a process in which the press position of the card 21 by the movable iron piece 20 is changed, a stable state due to surface contact can invariably be obtained. Therefore, it becomes possible to stabilize an operation state of the card 21 and the movable contact piece 43. In addition, in FIG. 14, although it is configured so that the upper boundary portion 52*a* of the movable iron piece 20 is brought into line contact with the card 21 during the initial driving, it is also possible to be configured that they are brought into surface contact with each other also at this position.

Further, in place of the surface contact portion 50, a curved portion (not shown) may be formed. That is, in place of the inclined surface of the surface contact portion 50 shown in FIG. 13, the surface contact portion 50 is formed of a curved surface that protrudes in an arc shape in cross section. Then, accompanied by rotation of the movable iron piece 20, a contact position of the card pressing portion 36 with respect to the curved surface of the card 21 is gradually changed. In more detail, the contact position is changed so as to gradually approach the rotation center (shaft portions 41) from a position distant from the rotation center (shaft portions 41). Thereby, a force required to rotate the card 21 can be gradually changed from a small value to a big value. Therefore, it becomes possible to smoothly perform a series of operations of the movable iron piece 20, the card 21 and the movable contact piece 43.

The electromagnetic relay 1 is used, for example, by being fitted into a socket 53 as shown in FIG. 16. The socket 53 has a thickness almost equal to that of the electromagnetic relay 1, and is formed with a recess 54 in which a lower half of the electromagnetic relay 1 can be fitted. In the recess 54, terminal holes 54*a*, into which the respective terminals protruding from the base 2 of the electromagnetic relay 1 can be inserted, are formed, and when the terminals are inserted, they are nipped by nipping portions 59*a* of inside terminals 59. Further, a wall surface forming the recess 54 is provided with a roughly L-shaped arm member 55 which is rotated around a support shaft 55*a*. One end portion of the arm member 55 serves as an operation portion 56 protruding from a front end surface of the socket 53. A part of the operation portion 56 forms a hooking portion 57 that is hooked onto the hooking pawl 5*a* (FIG. 1) of the electromagnetic relay 1 fitted into the recess 54. Further, those portions other than the operation portion are positioned in the socket 53. When the operation portion 56 is laterally operated (in an arrow direction), the arm member 55 is rotated around the support shaft 55*a*, so that the other end portion (a push-out portion 58) is protruded to the inside of the recess 54. Thereby, mere operation of the operation portion 56 makes it possible to separate the hooking portion 57 from the hooking pawl 5*a* and push out the electromagnetic relay 1 from the recess 54 by the push-out portion 58. Accordingly, it becomes possible to smoothly remove the electromagnetic relay 1 from the recess 54.

INDUSTRIAL APPLICABILITY

It goes without saying that the present invention may be applied not only to the above electromagnetic relay, but also to other electromagnetic relays.

The invention claimed is:

1. An electromagnetic relay wherein a movable iron piece is rotated by excitation or non-excitation of an electromagnet, a movable contact piece is elastically deformed by the movable iron piece through a card, and a movable contact provided on the movable contact piece opens and closes fixed contacts of fixed contact pieces disposed facing the movable contact piece, wherein the movable iron piece is provided with a card pressing portion capable of pressing the card;

wherein the card is provided with a contact piece pressing portion capable of pressing the movable contact piece by being rotated around a fulcrum;

wherein a press position changing portion, with which the movable iron piece changes a position for pressing the card, is provided on at least one of the movable iron piece and the card;

wherein the press position changing portion is disposed at a location apart from the distal end of the card pressing portion; and wherein the press position changing portion has a first position in which the card pressing portion starts to transmit force to the card through the press position changing portion, and a second position in which the movable iron piece directly transmits force to the card not through the press position changing portion.

2. The electromagnetic relay according to claim 1, wherein the press position changing portion is a protruding portion provided on at least any one of the movable iron piece and the card.

3. The electromagnetic relay according to claim 1, wherein the press position changing portion is provided with a surface contact portion where a part of the movable iron piece and a part of the card come into surface contact with each other.

4. The electromagnetic relay according to claim 1, wherein the press position changing portion is provided on at least any one of the movable iron piece and the card, and is formed of a curved surface which gradually displaces a contact position to the fulcrum side.

5. The electromagnetic relay according to claim 1, wherein the fulcrum of the card is provided with a pair of shaft portions which are coaxially disposed, each of the shaft portions is provided at each of bifurcated elastic deforming portions, and, by elastic deformation of the elastic deforming portions, the shaft portions are engaged in shaft-receiving holes provided in a base on which the electromagnet is placed so as to be freely rotatably supported.

6. The electromagnetic relay according to claim 2, wherein the fulcrum of the card is provided with a pair of shaft portions which are coaxially disposed, each of the shaft portions is provided at each of bifurcated elastic deforming portions, and, by elastic deformation of the elastic deforming portions, the shaft portions are engaged in shaft-receiving holes provided in a base on which the electromagnet is placed so as to be freely rotatably supported.

7. The electromagnetic relay according to claim 3, wherein the fulcrum of the card is provided with a pair of shaft portions which are coaxially disposed, each of the shaft portions is provided at each of bifurcated elastic deforming portions, and, by elastic deformation of the elastic deforming portions, the shaft portions are engaged in shaft-receiving holes provided in a base on which the electromagnet is placed so as to be freely rotatably supported.

8. The electromagnetic relay according to claim 4, wherein the fulcrum of the card is provided with a pair of shaft portions which are coaxially disposed, each of the shaft portions is provided at each of bifurcated elastic deforming portions, and, by elastic deformation of the elastic deforming portions, the shaft portions are engaged in shaft-receiving holes provided in a base on which the electromagnet is placed so as to be freely rotatably supported.

* * * * *